US008893644B2

(12) United States Patent
Nakamura et al.

(10) Patent No.: US 8,893,644 B2
(45) Date of Patent: Nov. 25, 2014

(54) WIDE SLIT NOZZLE FOR DISCHARGING A DAMPING MATERIAL IN AN OVERLAPPING MANNER WITH FIXED DIMENSIONS

(75) Inventors: Kazuhiko Nakamura, Toyoake (JP); Akira Nonoyama, Chiryu (JP); Shigeo Mori, Okazaki (JP); Hisashi Kato, Nagoya (JP)

(73) Assignee: Aisin Kako Kabushiki Kaisha, Nishikamo-gun (JP)

( * ) Notice: Subject to any disclaimer, the term of this patent is extended or adjusted under 35 U.S.C. 154(b) by 1363 days.

(21) Appl. No.: 11/902,402

(22) Filed: Sep. 21, 2007

(65) Prior Publication Data

US 2008/0083843 A1 Apr. 10, 2008

Related U.S. Application Data

(62) Division of application No. 10/370,071, filed on Feb. 21, 2003, now Pat. No. 7,285,309.

(30) Foreign Application Priority Data

Feb. 21, 2002 (JP) ..... 2002-044458
Jan. 31, 2003 (JP) ..... 2003-024561

(51) Int. Cl.
*B05B 13/02* (2006.01)

(Continued)

(52) U.S. Cl.
CPC ..... *B05C 5/0254* (2013.01); *B05B 1/044* (2013.01); *B05B 1/20* (2013.01); *Y10S 118/02* (2013.01); *Y10S 118/04* (2013.01)
USPC ..... 118/321; 118/DIG. 2; 118/DIG. 4; 118/24; 118/668; 118/677; 427/402; 427/420; 239/592; 239/601; 239/597

(58) Field of Classification Search
USPC ..... 118/300, 323, 221, 314, 321, 24, 118/DIG. 2, DIG. 4, 668, 669, 677; 239/594, 239/597, 599, 596, 601
See application file for complete search history.

(56) References Cited

U.S. PATENT DOCUMENTS 1,151,258 A * 8/1915 Fischer ..... 239/596
2,631,949 A * 3/1953 Kronthal ..... 427/191

(Continued)

FOREIGN PATENT DOCUMENTS

DE 85 34 594 U1 2/1986
EP 0 611 886 A1 2/1994

(Continued)

OTHER PUBLICATIONS

European Search Report dated Sep. 5, 2008 corresponding to European Patent Application No. 03003844.2.

(Continued)

*Primary Examiner* — Dah-Wei D Yuan
*Assistant Examiner* — Karl Kurple
(74) *Attorney, Agent, or Firm* — Westerman, Hattori, Daniels & Adrian, LLP

(57) ABSTRACT

A wide slit nozzle having a slit as a discharge opening. The thickness of a lateral end part is set smaller than the thickness at a lateral center part. The thickness of the lateral center part is fixed. The thickness of the lateral end part changes linearly from opposite lateral ends of the lateral center part to the opposite lateral ends of the slit. Coating material is discharged from the slit while applied with pressure, so that the coating material is coated while expanded wider than the width of the slit. The coating material is discharged at 7 liter per minute, and a coating width of a first example is 100 mm, for example. A thickness increase of the overlapped part is +25% even when a width or an overlapped margin z of the overlapped part is 10 mm or 20 mm.

2 Claims, 4 Drawing Sheets

(51) Int. Cl.

| | |
|---|---|
| ***B05C 5/00*** | (2006.01) |
| ***B05B 1/04*** | (2006.01) |
| ***B05B 1/00*** | (2006.01) |
| ***A62C 31/02*** | (2006.01) |
| ***B05C 5/02*** | (2006.01) |
| ***B05B 1/20*** | (2006.01) |
| *B05C 11/00* | (2006.01) |
| *B05D 1/36* | (2006.01) |
| *B05D 1/30* | (2006.01) |

(56) References Cited

U.S. PATENT DOCUMENTS

| | | | | | |
|---|---|---|---|---|---|
| 2,774,631 | A | * | 12/1956 | Wahlin | 239/590.3 |
| 2,788,051 | A | * | 4/1957 | Tuttle | 425/114 |
| 3,057,010 | A | * | 10/1962 | Reifenhauser | 425/466 |
| 3,126,574 | A | * | 3/1964 | Fox | 401/264 |
| 3,206,323 | A | * | 9/1965 | Miller et al. | 430/531 |
| 3,642,181 | A | * | 2/1972 | Thomas et al. | 222/517 |
| 3,653,560 | A | * | 4/1972 | Adams et al. | 222/566 |
| 4,133,202 | A | * | 1/1979 | Marple | 73/28.06 |
| 4,220,114 | A | * | 9/1980 | Radowicz | 118/411 |
| 4,346,849 | A | * | 8/1982 | Rood | 239/597 |
| 4,372,739 | A | * | 2/1983 | Vetter et al. | 425/466 |
| 4,527,507 | A | | 7/1985 | Sawai et al. | |
| 4,659,016 | A | * | 4/1987 | Faulkner, III | 239/135 |
| 4,679,711 | A | * | 7/1987 | Trevathan | 222/330 |
| 4,744,330 | A | * | 5/1988 | Claassen | 118/410 |
| 4,756,271 | A | * | 7/1988 | Maier | 118/411 |
| 4,844,004 | A | * | 7/1989 | Hadzimihalis et al. | 118/315 |
| 4,880,663 | A | * | 11/1989 | Shimada | 427/96.4 |
| 4,957,225 | A | * | 9/1990 | Childers | 222/568 |
| 4,964,362 | A | * | 10/1990 | Dominguez | 118/315 |
| 5,000,112 | A | * | 3/1991 | Rothen et al. | 118/411 |
| 5,000,361 | A | | 3/1991 | Briddell et al. | |
| 5,143,302 | A | * | 9/1992 | Sakuma | 239/599 |
| 5,288,027 | A | * | 2/1994 | Herstek et al. | 239/594 |
| 5,335,825 | A | * | 8/1994 | Fort | 222/1 |
| 5,397,514 | A | * | 3/1995 | Breil et al. | 264/40.1 |
| 5,498,103 | A | * | 3/1996 | Bauer, III | 404/107 |
| 5,573,281 | A | * | 11/1996 | Keller | 285/40 |
| 5,607,726 | A | * | 3/1997 | Flattery et al. | 427/261 |
| 5,700,322 | A | * | 12/1997 | Fort | 427/207.1 |
| 5,700,325 | A | * | 12/1997 | Watanabe | 118/411 |
| 5,797,692 | A | * | 8/1998 | Poole et al. | 401/266 |
| 5,823,387 | A | * | 10/1998 | Manadanas et al. | 222/1 |
| 5,881,958 | A | * | 3/1999 | Asakawa et al. | 239/589 |
| 5,909,846 | A | * | 6/1999 | Sasaki | 239/106 |
| D413,236 | S | * | 8/1999 | De Montigny | D8/14.1 |
| 5,976,256 | A | | 11/1999 | Kawano | |
| 6,040,016 | A | * | 3/2000 | Mitani et al. | 427/72 |
| 6,153,709 | A | | 11/2000 | Xiao et al. | |
| 6,371,751 | B1 | * | 4/2002 | Aneja et al. | 425/382.2 |
| 6,394,369 | B2 | * | 5/2002 | Goenka et al. | 239/601 |
| 6,626,738 | B1 | * | 9/2003 | Shank | 451/39 |
| 6,692,572 | B1 | * | 2/2004 | Allen | 118/685 |
| 6,740,399 | B1 | * | 5/2004 | George et al. | 428/355 EP |
| 6,742,730 | B2 | * | 6/2004 | Kassanits | 239/597 |
| 6,749,688 | B2 | * | 6/2004 | Tateyama et al. | 118/667 |
| 6,752,685 | B2 | * | 6/2004 | Ulrich et al. | 451/2 |
| 7,325,994 | B2 | * | 2/2008 | Liberatore | 401/266 |
| 7,377,979 | B2 | * | 5/2008 | Sakayori et al. | 118/323 |
| 7,591,903 | B2 | * | 9/2009 | Maier et al. | 118/411 |
| 7,846,504 | B2 | * | 12/2010 | Maier et al. | 427/356 |
| 8,118,198 | B1 | * | 2/2012 | Watson | 222/462 |
| 8,171,973 | B2 | * | 5/2012 | Ganzer et al. | 156/500 |
| 8,347,809 | B2 | * | 1/2013 | Takahashi et al. | 118/300 |
| 2001/0030250 | A1 | | 10/2001 | Goenka et al. | |
| 2002/0179745 | A1 | | 12/2002 | Dolan et al. | |
| 2003/0197076 | A1 | * | 10/2003 | Iwamoto et al. | 239/597 |
| 2004/0217202 | A1 | * | 11/2004 | Hynes | 239/380 |
| 2008/0035677 | A1 | * | 2/2008 | Daansen | 222/310 |
| 2010/0084429 | A1 | * | 4/2010 | Krawzyzk et al. | 222/129 |
| 2010/0130022 | A1 | * | 5/2010 | Park et al. | 438/758 |
| 2011/0168090 | A1 | * | 7/2011 | Clark et al. | 118/620 |
| 2013/0233886 | A1 | * | 9/2013 | Long et al. | 222/95 |

FOREIGN PATENT DOCUMENTS

| | | | |
|---|---|---|---|
| GB | 2 326 609 | A | 6/1998 |
| JP | S52-117607 | | 9/1977 |
| JP | S54-3144 | | 1/1979 |
| JP | 09-141178 | A | 6/1997 |
| JP | 2000-237679 | | 9/2000 |
| JP | 2000-237679 | A | 9/2000 |
| JP | 2001-129454 | A | 5/2001 |

OTHER PUBLICATIONS

Chinese Office Action dated Nov. 17, 2010, issued in corresponding Chinese Patent Application No. 200910128899.4.

* cited by examiner

WIDE SLIT NOZZLE FOR DISCHARGING A DAMPING MATERIAL IN AN OVERLAPPING MANNER WITH FIXED DIMENSIONS

CROSS-REFERENCE TO RELATED APPLICATIONS

This application is divisional of application Ser. No. 10/370,071, filed Feb. 21, 2003, which is based upon and claims priority of Japanese Patent Application Nos. 2002-044458, filed on Feb. 21, 2002 and 2003-024561, filed on Jan. 31, 2003, the contents being incorporated herein by reference.

BACKGROUND OF THE INVENTION

1. Field of the Invention

The present invention relates to a wide slit nozzle and a method by such wide slit nozzle, that are used for coating a coated-type vibration damping material on a vehicle or the like, while overlapping part of coated material sheets without a gap, so that the coated material is capable of improving vibration damping ability, and that can be used for general purpose coating.

2. Description of the Related Art

A vibration damping material is spread out on a vehicle floor for the purpose of vibration damping and noise control. An asphalt sheet has been used for such vibration damping material so far, but some problems still remain. That is, powders resting on a surface cause irregularity on the surface after painting. Moreover, workers need to work hard since 5 to 15 kg of the asphalt sheet must be constructed per one automobile. Furthermore, the asphalt sheets require a large storage space. To improve those demerits, a new art has been developed which coats a material having vibration damping effects on the automobile floor instead of spreading the asphalt sheet. One conventional example is disclosed in Japanese Laid Open Patent Publication No. 2000-237679.

In this prior invention, acrylic emulsion type water soluble coating material is used as the vibration damping material of the vehicle floor. The surface of the vehicle body's floor is coated with the vibration damping material using a nozzle having a special opening, so that a coating film or layer that has a grid or grating pattern is formed on the surface. Thereby, more reliable noise control effect can be obtained.

Referring to FIGS. 5(*a*) to 5(*c*), problems of such technique are to be explained. FIG. 5(*a*) is a front elevation view of a conventional nozzle seen from a discharge face side. FIG. 5(*b*) is a perspective view showing a case of coating vibration damping materials with their edges overlapped on a vehicle floor using the conventional nozzle. FIG. 5(*c*) is also a perspective view showing a case of coating the vibration damping materials with a certain space there between. Moreover, in FIGS. 5(*a*) to 5(*c*), a height or a thickness of a slit is illustrated much bigger to a length thereof. An actual height of the slit is very small. A thickness of the vibration damping material discharged from the slit is much larger than the height of the slit, since it is applied with a pressure.

As shown in FIG (a), in the technique described in the publication, the slit or a discharge opening 12 of the nozzle 11 has an even height γ from one edge to another edge. So, when vibration damping material lines P3 and P4 are coated side by side, if the previous line P3 and the present line P4 are coated with their edges overlapped, such overlapped part rises much higher than the other parts as shown in FIG. 5(*a*). Accordingly, the higher part interferes with parts or components mounted on the vehicle floor and pipe arrangements lined on the floor.

To prevent such interference, a space 15 is set between the previously coated line P3 and the presently coated line P4 in a practical use, as shown in FIG. 3(*c*). Though, it has become clear that this space 15 causes a bigger vibration in a certain frequency, so that vibration damping ability degrades.

BRIEF SUMMARY OF THE INVENTION

It is an object of this invention to provide a wide slit nozzle and a coating method by the wide slit nozzle which are capable of coating vibration damping materials on a floor with no space therebetween and with an overlapped part rising very little in case of coating the vibration damping materials with their edges overlapped.

According to a first aspect of the invention, there is provided a wide slit nozzle comprising a slit as a discharge opening for a coating material. The slit has a thickness that is parallel to a coating thickness direction of the coating material and a width that is perpendicular to the coating thickness direction. The thickness of the slit is smaller in dimension than the width of the slit so that the coating material is coated while a size of the slit being set in a two-dimensional direction. The wide slit nozzle is used such that a plurality of the coating materials is discharged from a plurality of the slits, respectively, so that the coating materials are disposed in parallel on a surface of an object to be coated, while adjacent lateral end parts of the coating materials being overlapped on each other, whereby each of the coating materials has a first thickness at a first part where the coating materials are not overlapped and a second thickness at a second part where the coating materials are overlapped. The slit has a curved outline at least in part so as to make constant the first thickness, a total of the second thicknesses at an overlapped area of the coating materials and a change of the second thickness of each of the coating materials.

In a wide slit nozzle, the coating material may have a viscosity of 0.1 Pa·s/20° C. or more (shear rate of 9400 $s^{-1}$ or more).

In a wide slit nozzle, the first thickness of the first part of the slit may be fixed and a width perpendicular to the coating thickness direction of the first part of the slit may be within a range between about 33% and about 45% of an entire width of the slit.

In a wide slit nozzle, a pair of the second parts of the slit may be located at opposite lateral end parts of the slit and a thickness at the lateral ends of the slit may be one half of the first thickness of the first part of the slit.

According to a second aspect of the invention, there is provided a wide slit nozzle comprising a slit as a discharge opening for a coating material. The slit has a thickness that is parallel to a coating thickness direction of the coating material and a width that is perpendicular to the coating thickness direction, the thickness of the slit being smaller in dimension than the width of the slit so that the coating material is coated while a size of the slit being set in a two-dimensional direction. The slit has a fixed thickness part located at a lateral center part and a pair of changing thickness parts located at a pair of lateral end parts. The fixed thickness part has a fixed thickness parallel to the coating thickness direction. Each of the changing thickness parts changes a thickness parallel to the coating thickness directions so that the thickness of the changing thickness part decreases linearly from a corresponding lateral end of the fixed thickness part to a corresponding lateral end of the slit.

In a wide slit nozzle, a width of the fixed thickness part of the slit may be within a range between about 33% and about 45% of an entire width of the slit.

In a wide slit nozzle, the thickness at each of the lateral ends of the slit may be about one half of the thickness of the fixed thickness part of the slit.

According to a third aspect of the invention, there is provided a coating method by a wide slit nozzle comprising a slit as a discharge opening for a coating material. The slit has a thickness parallel to a coating thickness direction of the coating material and a width perpendicular to the coating thickness direction. The thickness of the slit is smaller in dimension than the width of the slit so that the coating material is coated while a size of the slit being set in a two-dimensional direction. The slit has a fixed thickness part located at a lateral center part and a pair of changing thickness parts located at a pair of lateral end parts. The fixed thickness part has a fixed thickness parallel to the coating thickness direction. Each of the changing thickness parts changes a thickness parallel to the coating thickness directions so that the thickness of the changing thickness part decreases linearly from a corresponding lateral end of the fixed thickness part to a corresponding lateral end of the slit. The wide slit nozzle is used such that a plurality of the coating materials is discharged from a plurality of the slits, respectively, so that the coating materials are disposed in parallel on a surface of an object to be coated, while adjacent lateral end parts of the coating materials being overlapped on each other, whereby each of the coating materials has a first thickness at a first part where the coating materials are not overlapped and a second thickness at a second part where the coating materials are overlapped. The coating material discharged from the thickness changing parts of the slit defines an overlapped portion at the adjacent lateral end parts of the coating materials disposed on the surface of the object to be coated.

In a coating method by a wide slit nozzle, the coating materials may be overlapped at the adjacent lateral end parts thereof while a distance between adjacent wide slit nozzles being set such that a total thickness at the overlapped portion at the adjacent lateral end parts of the coating materials disposed on the surface of the object to be coated becomes substantially equal to a thickness of the coating material discharged from the fixed thickness part of the slit.

Further objects and advantages of the invention will be apparent from the following description, reference being had to the accompanying drawings, wherein preferred embodiments of the invention are clearly shown.

BRIEF DESCRIPTION OF THE SEVERAL VIEWS OF THE DRAWINGS

FIG. 1(*b*) is a perspective view showing a state in which coating material are coated with their edges overlapped using a wide slit nozzle according to the embodiment of the invention.

FIG. 5(*b*) is a perspective view showing a case of coating vibration damping materials with their edges overlapped on a vehicle floor using the conventional nozzle.

FIG. 5(*c*) is also a perspective view showing a case of coating the vibration damping materials with a certain space therebetween.

DETAILED DESCRIPTION OF THE INVENTION

Figure 1A:
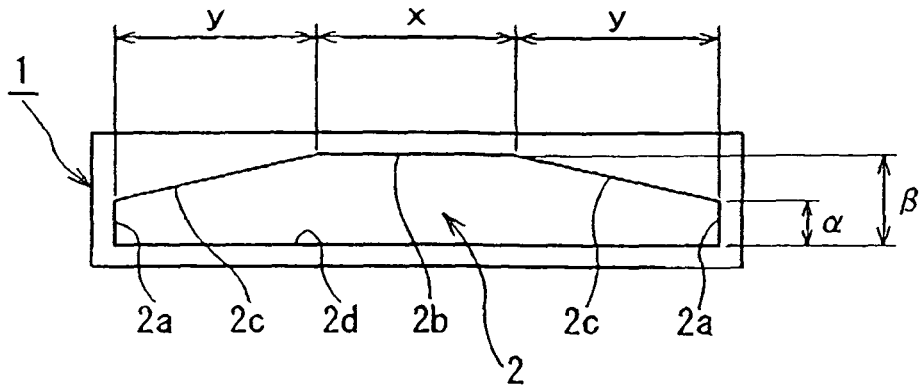
FIG. 1(*a*) is a front elevation view seen from a discharge face according to an embodiment of the invention.
Figure 1B:
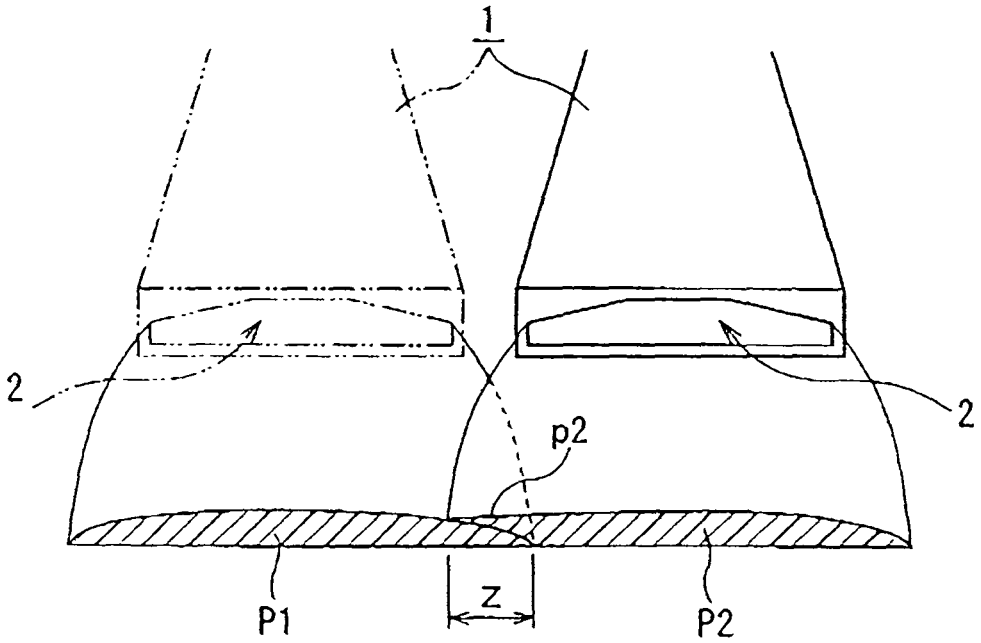
Figure 2:
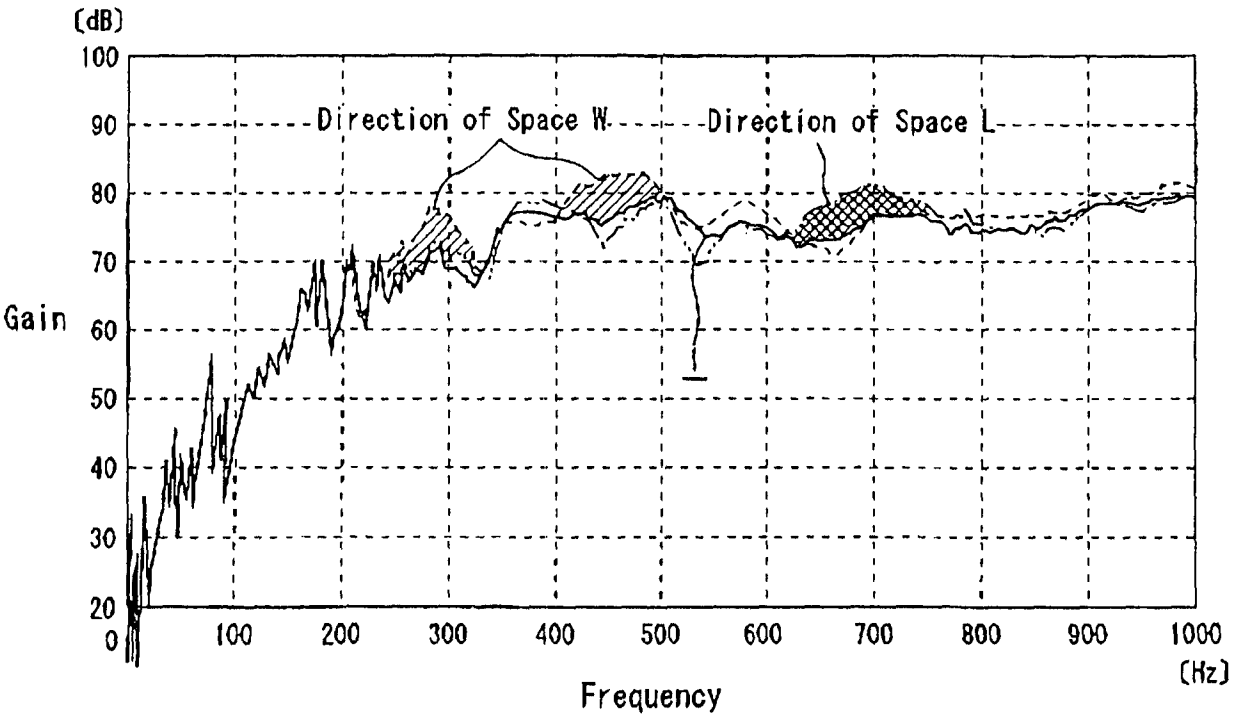
FIG. 2 is a graph showing a relation between a direction of the space between vibration damping materials and a frequency of vibration at which the vibration increases.

An embodiment and examples of the invention are described below with reference to the attached drawings. FIG. 1(*a*) is a front elevation view seen from a discharge face according to an embodiment of the invention. FIG. 1(*b*) is a perspective view, showing a state in which coating material are coated with their edges overlapped using a wide slit nozzle according to the embodiment of the invention. FIG. 2 is a graph showing a relation between a direction of the space between vibration damping materials and a frequency of vibration at which the vibration increases. In FIG. 1, a height or a thickness of a slit (discharge opening) 2 is illustrated much bigger to a length thereof. An actual height of the slit is very small. A thickness of the vibration damping material discharged from the slit is much larger than the height of the slit, since it is applied with a pressure. A coating direction (of the slit) may mean a "thickness direction of the vibration damping material" in the specification and claims of the present application. Moreover, the height or the thickness of the vibration damping material in FIG. 1 may be referred to as a "width parallel to the coating direction of the slit" in the specification and claims of the present application.

Referring to FIG. 1(*a*), a wide slit nozzle 1 according to an embodiment of the invention has a slit or a discharge opening 2. A height or a width $\alpha$, that is parallel to the coating direction of the slit 2, of opposite ends 2*a* of the slit is set smaller than a height $\beta$ or a width $\alpha$, that is parallel to the coating direction of the slit 2, of the slit 2 at a nozzle center part 2*b*. In the embodiment, the height $\alpha$ is about half of the height $\beta$. Thus, there is provided a part 2*b* at the nozzle center part where the height of the slit 2 is constant. A pair of parts 2*c* is provided while extending from opposite ends of the part 2*b* to the opposite ends 2*a* of the nozzle. Thus, the height of the parts 2*c* changes linearly. A length of the constant height part 2*b* is x mm. A horizontal length of the linearly changing height part 2*c* is y mm. In contrast, a bottom 2*d* of the slit 2 is formed linearly.

Using the wide slit nozzle 1 having a shape of the slit 2, a coating material is coated on a vehicle floor. Experiments were carried out for a conventional nozzle 11 as well as nozzles having different dimensions x, y, $\alpha$ and $\beta$ for comparison. Results are shown in Table 1.

TABLE 1

| | Conventional | Example | | Comparative Example | | | | |
|---|---|---|---|---|---|---|---|---|
| | nozzle 11 | 1 | 2 | 1 | 2 | 3 | 4 | 5 |
| x | — | 15 | 19 | 20 | 14 | 10 | 15 | 15 |
| y | — | 14 | 12 | 11.5 | 14.5 | 16.5 | 14 | 14 |

TABLE 1-continued

| | Conventional | Example | | Comparative Example | | | | |
|---|---|---|---|---|---|---|---|---|
| | nozzle 11 | 1 | 2 | 1 | 2 | 3 | 4 | 5 |
| α | 0.9 | 0.3 | 0.3 | 0.3 | 0.3 | 0.3 | 0.4 | 0.25 |
| β | 0.9 | 0.6 | 0.6 | 0.6 | 0.6 | 0.6 | 0.8 | 0.5 |
| Thickness of Overlapped portion Z 10 mm | +150% | +25% | +25% | +25% | +25% | +25% | +25% | +25% |
| Thickness of Overlapped portion Z 20 mm | +150% | +25% | +35% | +50% | +50% | +25% | +25% | +25% |
| Coating Width in 7 l/min | 100 mm | 100 mm | 100 mm | 100 mm | 90 mm | 80 mm | 80 mm | 120 mm |
| Judgement | x | ○ | ○ | x | x | x | x | x |

As shown in Table 1, a first example of a nozzle according to the present embodiment has a slit of dimensions: x=15 mm, y=14 mm, α=0.3 mm and β=0.6 mm. Consequently, an entire length or an entire width of the slit 2 is 15+14×2=43 mm. However, the coating material is discharged from the slit 2 while applied with pressure, so that the coating material is coated while expanded wider than the width of the slit 2. In all the examples, the coating material is discharged at 7 liter per minute, and a coating width of the first example is 100 mm. As shown in FIG. 1(*b*), a thickness increase of the overlapped part p2 is +25% even when a width or an overlapped margin z of the overlapped part p2 is 10 mm or 20 mm. Thus, the thickness increase is so little that there is no problem that the overlapped part interferes with the parts and components or pipes arranged on the floor.

In contrast, in case of the conventional nozzle 11, α and β are both 0.9 mm and equals to γ. The coating width is 100 mm and the same as that of the first example. However, the thickness increase of the overlapped part reaches +150% even when the overlapped margin z is 10 mm or 20 mm. Thus, the overlapped part interferes with the parts and components or pipes arranged on the floor. Consequently, it is difficult to put the conventional nozzle 11 into practical use.

In case of a second example, x=19 mm and y=12 mm and the length of the center part 2*b* is longer than that of the first example. Still, the coating width is 100 mm and the same as that of the first example. The thickness increase of the overlapped part is +25% and the same as that of the first embodiment when the overlapped margin z is 10 mm. The thickness increase of the overlapped part is +35% and a little larger when the overlapped margin z is 20 mm. However, such thickness increase is still kept at a small value. Therefore, it has no problem for practical use.

In contrast, in case of the first comparative example, x=20 mm and y=11.5 mm and the length of the center part 2*b* of the slit 2 is longer than that of the second example. Therefore, the coating width is 100 mm and the same as that of the first or second example. The thickness increase of the overlapped part is +25% and there is no problem when the overlapped margin z is 10 mm. However, the thickness increase of the overlapped part is +55% and becomes too large when the overlapped margin z is 20 mm.

Further, in case of the second comparative example, x=14 mm and y=14.5 mm and the length of the center part 2*b* of the slit 2 is 1 mm longer than that of the first example. Thereby, the thickness increase of the overlapped part is +25% and there is no problem when the overlapped margin z is 10 mm. However, the thickness increase of the overlapped part is +50% and becomes too large when the overlapped margin z is 20 mm. Moreover, the coating width is 90 mm and becomes smaller. If the coating width of each coating step becomes smaller than a fixed width (100 mm in the present embodiment) as described above, there takes place a problem in practical use, because it is impossible to complete floor coating in a fixed tact time in a production line.

According to the third comparative example, x=10 mm and y=16.5 mm and the length of the center part 2*b* of slit 2 is shorter than the second comparative example. Thereby, the thickness increase of the overlapped part is +25% and there is no problem when the overlapped margin z is 10 mm or 20 mm. However, the coating width is 80 mm and becomes smaller than the second comparative example. Consequently, there takes place a problem in practical use, because it is impossible to complete floor coating in the fixed tact time.

The first to third comparative examples show the cases in which the thickness values α and β are the same as those of the first and second examples but the values x and y in the width direction are changed. In contrast, the fourth and fifth comparative examples show cases in which the values x and y in the width direction are the same as those of the first example but thickness values α and β are changed. According to the fourth example, α=0.4 mm and β=0.8 mm and the thickness of slit 2 is thicker than the first example. The ratio between α and β is equal to that of the first example and β is twice as large as α. Thereby, the thickness increase of the overlapped part is +25% and there is no problem when the overlapped margin z is 10 mm or 20 mm. However, the coating width is 80 mm and becomes smaller. Consequently, there takes place a problem in practical use, because it is impossible to complete floor coating in the fixed tact time.

In contrast, according to the fifth comparative example, α=0.25 mm and β=0.5 mm and the thickness of the slit 2 is thinner than that of the first example. The ratio between α and β is equal to that of the first example and β is twice as large as α. Thereby, the thickness increase of the overlapped part is +25% and there is no problem when the overlapped margin z is 10 mm or 20 mm. However, the coating width is 120 mm and becomes larger. Such too wide coating width makes it impossible to have an edge of the coating material coincide with an edge of the floor at the time of finishing coating at the edge of the floor. Therefore, there takes place a problem in practical use.

As mentioned above, the optimum value of the size x, y, α and β of the slit 2 is very delicate. Especially for the value of x, 1 mm difference causes problems in practical use. As shown in Table 1, a suitable value of x is within a range about from 33% to 45% of the entire length of the slit 2.

Next, vibration damping ability is compared between a case in which the coating material is coated without any space 2 by use of the wide slit nozzle 1 of the present embodiment and a case in which the space is formed as in the conventional art, referring to FIG. 2. A continuous line in FIG. 2 shows the vibration damping ability of the vehicle floor in case the coating material is coated without making no spaces using the wide slit nozzle 1 of the present embodiment. As shown in FIG. 2, when the coating material is layered on the vehicle floor under the condition of the first example in Table 1, there is no frequency that deviates too much and fine vibration damping ability is obtained. On the other hand, when the space is formed in the width direction of the vehicle floor, strong vibration occurs at around 800 Hz or at around 400 to 500 Hz as shown by a broken line. Moreover, when the space is formed in a length direction of the vehicle floor, strong vibration occurs at around 600 to 750 Hz as shown by a one-dot chain line. These results show that the space should not be formed between the coating materials for the improvement of the vibration damping ability. In the present embodiment, a vibration damping material is used that has a viscosity of 1.5 Pa s/20° C. (shear rate of 9400 $s^{-1}$).

While the present embodiment describes the case in which the wide slit nozzle 1 is used for coating the vehicle floor, it is applicable to any fields which uses an airless coat method for acquiring a dustless coating state. For example, it is applicable to a chip proof coat for a vehicle, a painting for a house or an inside of a building, a train, a marine vessel and so on.

Moreover, the other construction, configuration, quantity, material, size and joint or connection and so on of the wide slit nozzle are not limited to those of the present embodiment in practicing the invention.

While the above embodiment is described as the wide silt nozzle 1, the present embodiment is characterized in a coating method by the wide slit nozzle 1. Therefore, the present invention can be grasped as the invention of the coating method.

Specifically, the coating method is concretized by use of the wide slit nozzle 1 having the slit 2. As described above, the nozzle 1 has the width in one direction that is larger than the thickness in a direction perpendicular to the width. The thickness α parallel to a coating thickness direction at the opposite lateral ends 2*a* of the slit 2 is smaller than the thickness β parallel to the coating thickness direction. Thus, the slit 2 has the fixed thickness part 2*b* located at the lateral center part and the pair of the changing thickness parts 2*c* located at a pair of the lateral end parts. The fixed thickness part 2*b* has the fixed thickness β parallel to the coating thickness direction. Each of the changing thickness parts 2*c* changes the thickness parallel to the coating thickness direction so that the thickness of the changing thickness part 2*c* decreases linearly from a corresponding lateral end of the fixed thickness part 2*b* to a corresponding lateral end 2*a* of the slit 2. In the coating method, the coating material discharged from the changing thickness parts 2*c* of the slit 2 defines an overlapped portion at the adjacent lateral end parts of the coating materials disposed on the surface of the object to be coated.

Accordingly, the total thickness of the overlapped portion of the coating materials is determined by the range within which the thickness parallel to the coating thickness direction of the slit 2 changes or decreases linearly. Consequently, the thickness of the overlapped portion of the coating materials never becomes about twice the thickness of the non-overlapped portion of the coating material in part or as a whole. As a result, the coating method that overlaps the coating materials enables finishing that is about equal to one layer coating method. Moreover, the wide slit nozzle 1 is formed such that the width of the overlapped portion of the coating materials is set so that the thickness of the slit 2 parallel to the coating thickness direction changes or decreases linearly from the fixed thickness part 2*b* to the lateral ends 2*a* of the slit 2. Therefore, the overlapped portion of the coating materials can be made into a desired thickness. Consequently, the coating thickness of the coating material can be made into a desired one in a finished state.

In the coating method by the wide slit nozzle 1, the coating materials are overlapped at the adjacent lateral end parts thereof while a distance between adjacent wide slit nozzles 1 being set such that a total thickness at the overlapped portion at the adjacent lateral end parts of the coating materials disposed on the surface of the object to be coated becomes substantially equal to a thickness of the coating material discharged from the fixed thickness part 2*b* of the slit 2. Accordingly, the coating thickness of the coating material can be made constant at the overlapped portion in the finished state. Moreover, the thickness of the slit 2 parallel to the coating thickness direction changes or decreases linearly toward the lateral ends 2*a* of the slit 2, so that it is easy to adjust the range of setting the width or the like of the overlapped portion.

As described above, in the present embodiment, the width of the overlapped portion of the coating materials is set while adjusting an overlapped amount by an spouted amount of the coating material from the changing thickness area 2*b* where the thickness of the slit 2 parallel to the coating thickness direction linearly changes or decreases toward the lateral end 2*a* of the slit 2. Therefore, the overlapped portion of the coating materials can be made into a desired thickness. Consequently, the coating thickness of the coating material can be made into a desired one in a finished state.

In order to improve the invention, the inventors made a variety of experiments while changing viscosity of the coating material. Then, the following results were obtained.

Figure 3:
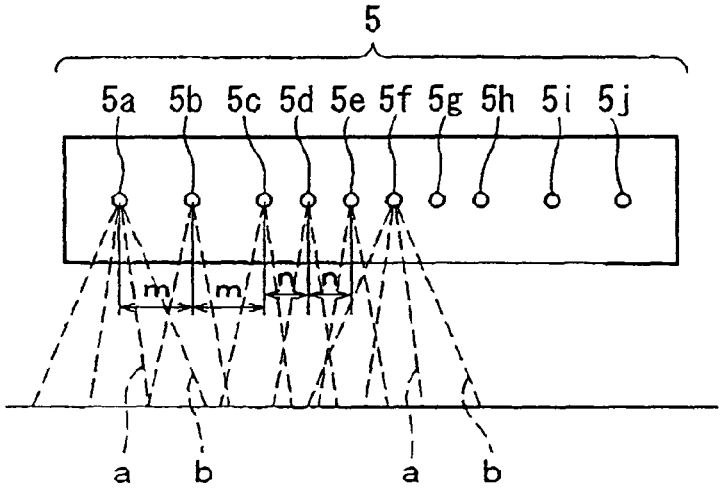
FIG. 3 is a front elevation of a second embodiment of a wide slit nozzle of the invention having a plurality of small holes that is figured out according to a concept of the wide slit nozzle 1 of the first embodiment, while viewed from a discharging surface thereof.
Figure 4A:
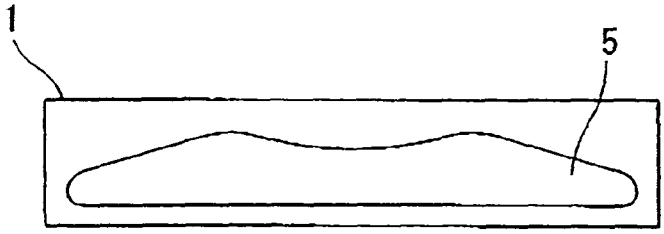
FIGS. 4(*a*) to 4(*c*) show various front elevations of a second embodiment of a wide slit nozzle of the invention, while viewed from a discharging surface thereof.
Figure 4B:
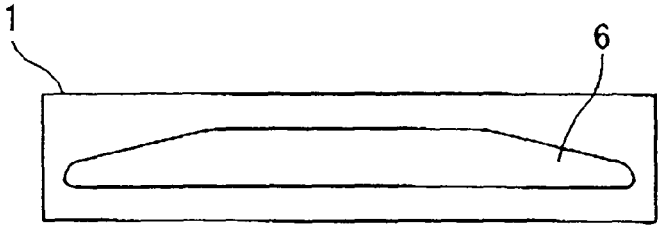
Figure 4C:
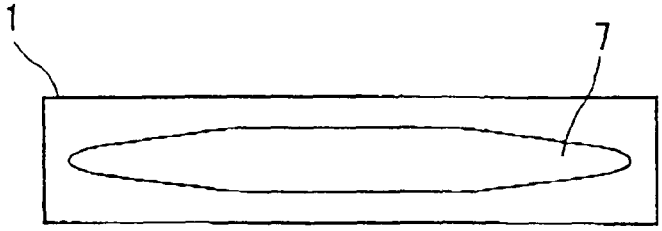
Figure 5A:
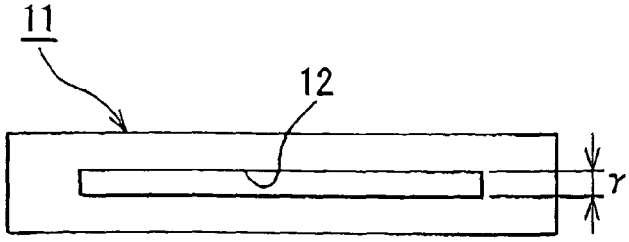
FIG. 5a Prior Art
FIG. 5(*a*) is a front elevation view of a conventional nozzle seen from a discharge face side.
Figure 5B:
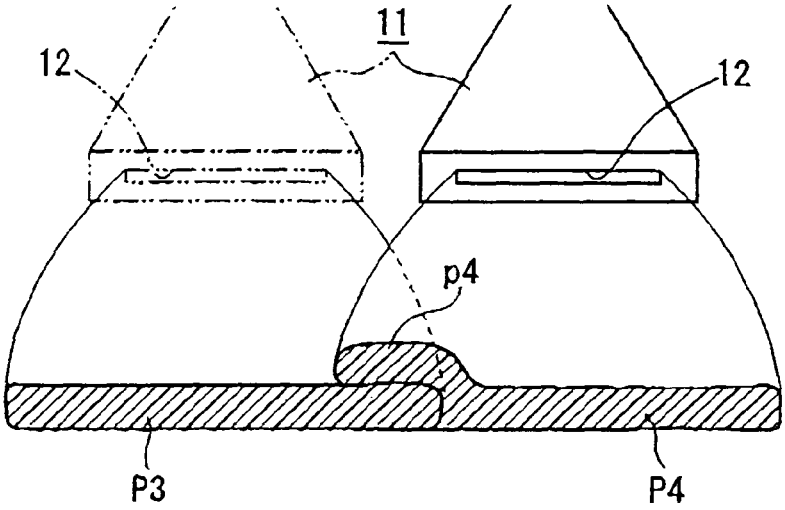
FIG. 5b Prior Art
Figure 5C:
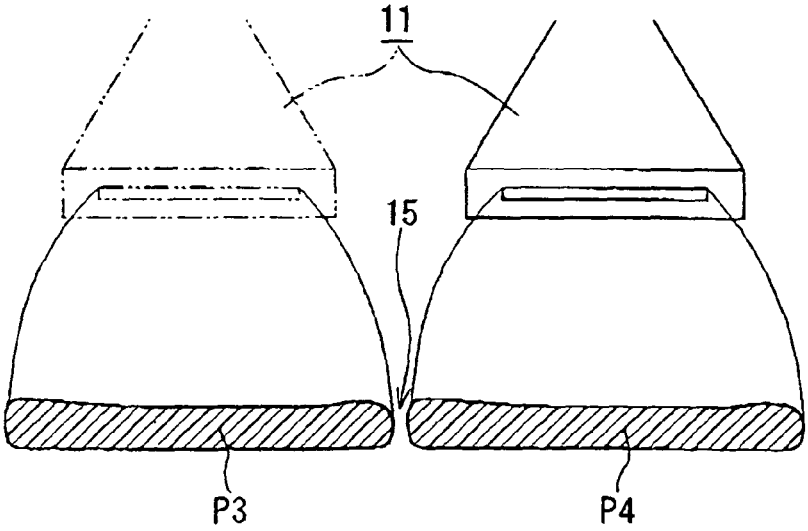
FIG. 5c Prior Art

FIG. 3 is a front elevation of a second embodiment of a wide slit nozzle of the invention having a plurality of small holes that is figured out according to a concept of the wide slit nozzle 1 of the first embodiment, while viewed from a discharging surface thereof. FIG. 4 is a front elevation of a second embodiment of a wide slit nozzle of the invention, while viewed from a discharging surface thereof. In the drawings, the same reference numerals or reference symbols show corresponding elements to the first embodiment. Thus, such elements are not described hereunder.

Referring to FIG. 3, the second embodiment of the wide slit nozzle has a slit 5. The slit 5 has a plurality of small holes 5*a*, 5*b*, 5*c*, 5*d*, - - - , 5*h*, 5*i*, 5*j* that is figured out according to a concept of the wide slit nozzle 1 of the first embodiment, while FIG. 3 depicts the front elevation thereof viewed from a discharging surface thereof. The small holes 5*a*, 5*b*, 5*c*, 5*d*, - - - , 5*h*, 5*i*, 5*j* have a same diameter. The small holes 5*a*, 5*b*, 5*c*, 5*d*, - - - , 5*h*, 5*i*, 5*j* are disposed at an interval of "m" pitch at a lateral center part along a width that is perpendicular to the coating thickness direction. The small holes 5*a*, 5*b*, 5*c*, 5*d*, - - - , 5*h*, 5*i*, 5*j* are disposed at an interval of "m" pitch at a pair of lateral end parts.

If the viscosity of the coating material is varied while setting constant a pressure of the coating material, the coating material is spread at an spouted angle "a" with a coating material having a high viscosity. In contrast, the coating material is spread at an spouted angle "b" or a wide spread state with a coating material having a low viscosity. The coating material spouted from the small holes 5*a*, 5*b*, 5*c*, 5*d*, - - - , 5*h*, 5*i*, 5*j* is coated in a thin state at the small hole nozzle 5*a* and 5*j* as a discharged opening and in a thickest state at the small hole nozzle 5*e* and 5*f*, when the coating material of the low viscosity is spouted in a wide spread state at the spouted angle of "b". In order to compensate the thickness, it is necessary to change the shape of the slit or discharged opening 5 of the wide slit nozzle 1 such that a center part has a narrow outline or smaller thickness as shown in FIG. 4(*a*). At this time, when comparing the overlapped area and the non-overlapped area of the coating material, the following relation is obtained. Specifically, the coating thickness of the coating material on the coated surface becomes nearly constant at the non-overlapped area of the coating materials. On the other hand, the change of the coating thickness to the distance in the width direction at the overlapped area becomes a desired thickness change by which the thickness of the coating material at the overlapped area becomes constant, for example. Thus, it is possible to finish a flat surface of the object to be coated.

According to the experiment by the inventors, the wide slit nozzle 1 can have another outline of a discharging opening 6 or a discharging opening 7 depending on the pressure and the viscosity of the coating material when the pressure and the viscosity of the coating material is changed. Specifically, as shown in FIG. 4(*b*) or FIG. 4(*c*), the discharging opening 6 or the discharging opening 7 has an outline formed by a curve that includes a curve that approximates to a straight line so that the change of the coating thickness to the distance in the width direction at the overlapped area becomes the desired thickness change. Then, the coating thickness of the coating material on the coated surface becomes nearly constant at the non-overlapped area of the coating materials. On the other hand, the change of the coating thickness to the distance in the width direction at the overlapped area becomes the desired thickness change. Thus, it is possible to finish a flat surface of the object to be coated.

As described above, according to the embodiment or the invention, the slit has a curved outline at least in part so as to make constant the first thickness, a total of the second thicknesses at an overlapped area of the coating materials and a change of the second thickness of each of the coating materials. Thus, the shape or outline of the discharging opening for coating is determined by results of coatings by such coating device, with disregard to the pressure to the coating material, fluid resistance of the coating material, viscosity of the coating material and the like. Consequently, an ideal coating becomes possible without any selection error.

According to the embodiment or the invention, the coating material may have a viscosity of 0.1 Pa·s/20° C. or more (shear rate of 9400 $s^{-1}$ or more). Then, the coating material to be coated is spread in a narrow state. Consequently, uneven coating tend to occur. However, the shape or outline of the discharging opening for coating can be determined by results of coatings by such coating device, with disregard to the pressure to the coating material, fluid resistance of the coating material, viscosity of the coating material and the like. Consequently, uneven coating is hard to be generated in contrast.

As explained above, the wide slit nozzle according to the embodiment or the invention is formed such that it has the wide discharge opening for the coating material. The height at the opposite lateral ends of the slit is smaller than the height of the center part of the nozzle of the slit so as to provide the part having the fixed height at the center part of the nozzle. The height of slit changes linearly from the opposite lateral ends of the part having the fixed height at the center part of the nozzle to the opposite lateral ends of the nozzle, respectively.

Accordingly, the coating material is discharged thin at the opposite lateral end portions of the discharge opening. The coating material is discharged gradually thicker as it comes nearer the center part. At the center part, the coating material is discharged with the fixed thickness. Consequently, if the next row of the coating material is layered on the previous row of the coating material so that the edge or marginal portions overlap with each other, the overlapped portion has substantially the same thickness as the that of the center part having the fixed thickness. As a result, the overlapped portion does not protrude and there is no space between the rows of the coating materials. Therefore, there is no problem that the vibration increases at a predetermined frequency thereby to deteriorate the vibration damping ability. Thus, there is provided a wide slit nozzle which is capable of coating vibration damping materials on a floor with no space therebetween and with an overlapped part rising very little in case of coating the vibration damping materials with their edges overlapped.

In the wide slit nozzle according to the embodiment or the invention, the length of the part having the fixed height at the center part of slit of the nozzle is preferably within the range between about 33% and about 45% of the entire length of the slit.

Accordingly, the length of the part having the fixed height of the slit and the part having the changing height of the slit are well balanced. Therefore, the overlapped portion has nearly a flat surface whether the width of the overlapped portion is larger or smaller. Consequently, it is possible to prevent such disadvantages as protrusions or dents of the overlapped portion.

As mentioned above, if the length of the part having the changing height is set within a predetermined range to the entire length of the nozzle, there is provided a wide slit nozzle that has the overlapped portion hardly protruded even if the width of the overlapped portion changes in a certain degree and that is capable of coating the coating material without spaces.

In the wide slit nozzle according to the embodiment or the invention, the height of the slit at the opposite ends of the nozzle is preferably about half the height of the slit at the center part of the nozzle.

Accordingly to the results of the experiment, the overlapped portion had nearly a flat surface whether the width of the overlapped portion was larger or smaller. Then, there took place no such problems as protrusions or dents of the overlapped portion.

As mentioned above, if the height of the slit at the opposite ends of the nozzle is about half the height of the slit at the center part of the nozzle, there is provided a wide slit nozzle that has the overlapped portion hardly protruded even if the width of the overlapped portion changes in a certain degree and that is capable of coating the coating material without spaces.

According to the coating method of the embodiment or the invention, the coating method is concretized by use of the wide slit nozzle having the slit. As described above, the nozzle has the width in one direction that is larger than the thickness in a direction perpendicular to the width. The thickness parallel to a coating thickness direction at the opposite lateral ends of the slit is smaller than the thickness parallel to the coating thickness direction. Thus, the slit has the fixed thickness part located at the lateral center part and the pair of the changing thickness parts located at a pair of the lateral end parts. The fixed thickness part has the fixed thickness parallel to the coating thickness direction. Each of the changing thickness parts changes the thickness parallel to the coating thickness direction so that the thickness of the changing thickness part decreases linearly from a corresponding lateral end of the fixed thickness part to a corresponding lateral end of the slit. In the coating method, the coating material discharged from the changing thickness parts of the slit defines an overlapped portion at the adjacent lateral end parts of the coating materials disposed on the surface of the object to be coated. Accordingly, it is prevented that the thickness of the overlapped portion of the coating materials becomes about twice the thickness of the non-overlapped portion of the coating material in part. As a result, the coating method enables finishing that is about equal to one layer coating method. Moreover, the overlapped portion coating is realized by the changing thickness area where the thickness of the slit 2 parallel to the coating thickness direction changes or decreases linearly toward the lateral ends of the slit. Therefore, the overlapped portion of the coating materials can be made into a desired thickness.

According to the coating method of the embodiment or the invention, the coating materials may be overlapped at the adjacent lateral end parts thereof while a distance between adjacent wide slit nozzles being set such that a total thickness at the overlapped portion at the adjacent lateral end parts of the coating materials disposed on the surface of the object to be coated becomes substantially equal to a thickness of the coating material discharged from the fixed thickness part of the slit. Accordingly, the coating thickness of the coating material can be made constant at the overlapped portion. Moreover, the thickness of the slit parallel to the coating thickness direction changes or decreases linearly toward the lateral ends of the slit, so that it is easy to adjust the range of setting the width or the like of the overlapped portion. As a result, the coating thickness of the coating material can be made constant at the overlapped portion.

The preferred embodiments described herein are illustrative and not restrictive, the scope of the invention being indicated in the appended claims and all variations which come within the meaning of the claims are intended to be embraced therein.

The invention claimed is:

1. A wide slit nozzle comprising:

a slit as a discharge opening configured to discharge a vibration damping material having a viscosity of 0.1 Pa·s/at 20° C. or more under a condition of a shear rate of 9400 $s^{-1}$ by an airless coat method to dispose sheets of the vibration damping material in a parallel and overlapping manner on a surface of an object to be coated so as to mistlessly coat the surface of the object:

wherein the slit has a width perpendicular to a coating direction of the vibration damping material and a thickness parallel to the coating direction, the thickness of the slit being smaller in dimension than the width of the slit so that the vibration damping material is disposed with fixed dimensions in two directions;

wherein the slit has a lateral center part and a pair of lateral end parts, the lateral center part and the lateral end parts respectively having a width and a thickness configured to dispose the sheets of the vibration damping material on the object to be coated in a state in which the sheets of the vibration damping material are overlapped at adjacent lateral end parts of the vibration damping material sheets;

wherein the thickness of the lateral center part is a fixed thickness or a thickness decreasing toward the center of the lateral center part, and the width of the lateral center part is a width within a range from 33% to 45% of an entire width of the slit; and wherein the thickness of each of the lateral end parts is a thickness decreasing linearly from a corresponding lateral end of the lateral center part to a corresponding lateral end of the slit, and the thickness at each of the lateral parts of the slit is one half of the thickness of the lateral center part of the slit.

2. A wide slit nozzle according to claim 1, in which the thickness of the lateral center part and the thickness of the pair of the lateral end parts of the slit are set such that a total thickness at an overlapped portion at the adjacent lateral end parts of the parallel disposed sheets of the vibration damping material discharged from the lateral end parts of the slit becomes not more than 135% of a thickness of the sheet of the vibration damping material discharged from the lateral center part of the slit.

* * * * *